United States Patent [19]

Thomasson

[11] Patent Number: 4,494,351

[45] Date of Patent: Jan. 22, 1985

[54] BOOMS FOR CRANES OR THE LIKE

[75] Inventor: William R. Thomasson, County Durham, England

[73] Assignee: Coles Cranes Limited, Sunderland, England

[21] Appl. No.: 409,228

[22] Filed: Aug. 18, 1982

[30] Foreign Application Priority Data

Aug. 18, 1981 [GB] United Kingdom ..... 8125172

[51] Int. Cl.[3] ..... E04C 3/32

[52] U.S. Cl. ..... 52/690; 52/731

[58] Field of Search ..... 52/731, 632, 634, 636, 52/84, 192, 741, 657, 721, 690; 182/2; 212/266; 244/117 R, 119

[56] References Cited

U.S. PATENT DOCUMENTS

| | | | |
|---|---|---|---|
| 1,392,496 | 10/1921 | Hain | 249/DIG. 2 |
| 1,431,521 | 10/1922 | Hall | 52/84 |
| 1,691,818 | 11/1928 | Krass | 52/731 |
| 3,066,394 | 12/1962 | Litzka | 52/636 |
| 4,003,168 | 1/1977 | Brady | 52/731 |
| 4,109,440 | 8/1978 | Bill | 52/731 |
| 4,171,597 | 10/1979 | Lester et al. | 52/731 |
| 4,171,598 | 10/1979 | Holmes | 52/731 |

FOREIGN PATENT DOCUMENTS

| | | | |
|---|---|---|---|
| 508936 | 10/1920 | France | 244/117 R |
| 2336531 | 7/1977 | France | 52/731 |
| 412977 | 7/1934 | United Kingdom | 52/741 |
| 481248 | 3/1938 | United Kingdom | 52/192 |
| 921411 | 3/1963 | United Kingdom | 52/731 |

*Primary Examiner*—John E. Murtagh
*Assistant Examiner*—Andrew Joseph Rudy
*Attorney, Agent, or Firm*—Townsend and Townsend

[57] ABSTRACT

A boom for a crane or the like which comprises four longitudinal stiffening members interconnected with four substantially flat longitudinal plates in such a way that the boom has a substantially diamond shaped cross-section. Such a construction has considerable advantages as compared with normal rectangular section booms, e.g., reduction of stress at the corners, elimination of internal fillets, reduction of distortion and easier and better construction of the boom.

9 Claims, 4 Drawing Figures

BOOMS FOR CRANES OR THE LIKE

The present invention relates to booms for cranes or the like particularly those having a box construction.

Box type booms, that is booms constructed from plate as distinguished from lattice type booms, are well known and are used for telescoping booms where the boom sections are comparatively short. The box construction is normally rectilinear in cross-section although our U.S. Pat. No. 4,171,597 shows an octagonal construction which has certain advantages over the normal rectilinear shape. Certain disadvantages of the rectilinear shape are set out in our British Pat. No. 1,564,509. A particular disadvantage of both rectilinear and octagonal boom construction is evident when the boom is lengthened. In this case, additional stiffening in the form of internal stiffening members has to be provided. But then the assembly of boom components by welding standards require welds to run uninterrupted from end to end.

A boom for a crane or the like according to the invention comprises four longitudinal stiffening members spaced apart and four substantially flat longitudinal plates each welded between adjacent such stiffening members to form a boom with a substantially diamond shaped cross-section.

The stiffening members are preferably of rectangular hollow section.

The abutment between the plane longitudinal plates and the edges of the stiffening members enables a simple external butt weld to be run along the whole length of the boom without interruption which is simple to set up even with boom lengths of 20 m or more.

Considerable advantages of the present invention over rectangular section booms are the reduction of stress at the corners, elimination of internal fillets, reduction of distortion and easier and better welding during assembly.

Particular advantages of the present invention over octagonal section booms are that the plates between the stiffening members are narrower than the side plates of the octagonal section which reduces the buckling factor, the construction enables easier construction along the boom were the cross-sectional area varies and particularly at the boom foot where there is a large change in cross-sectional area, the stiffening member construction where this is of hollow section is less prone to corrosion and damage, the stress fluctuation at maximum stress position particularly during whip is improved, and the quality and dimensioning control is easier particularly if the boom is made as a single component.

Whilst the boom is particularly suitable for cranes and mobile cranes, it may also be used for example on access platforms (aerial lifts) or on other apparatus using similar booms and the expression "cranes and the like" is to be interpreted accordingly.

An embodiment of the invention will now be described by way of example with reference to the accompanying drawings in which.

Figure 1:
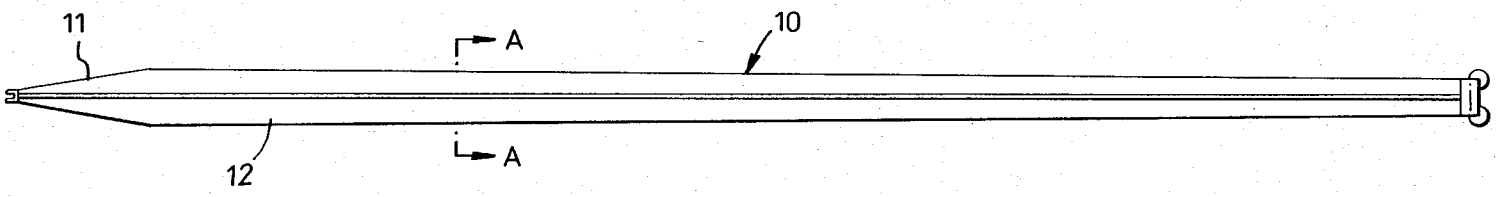
FIG. 1 is a side elevation of an example of a boom of the invention.
Figure 2:
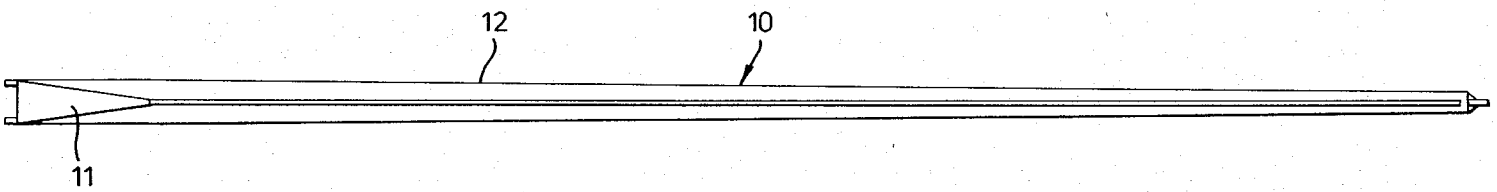
FIG. 2 is a top elevation of the boom of FIG. 1.

In FIGS. 1 and 2, a boom 10 is shown with a narrowing foot portion 11 and a slightly graduated main portion 12.

Figure 3:
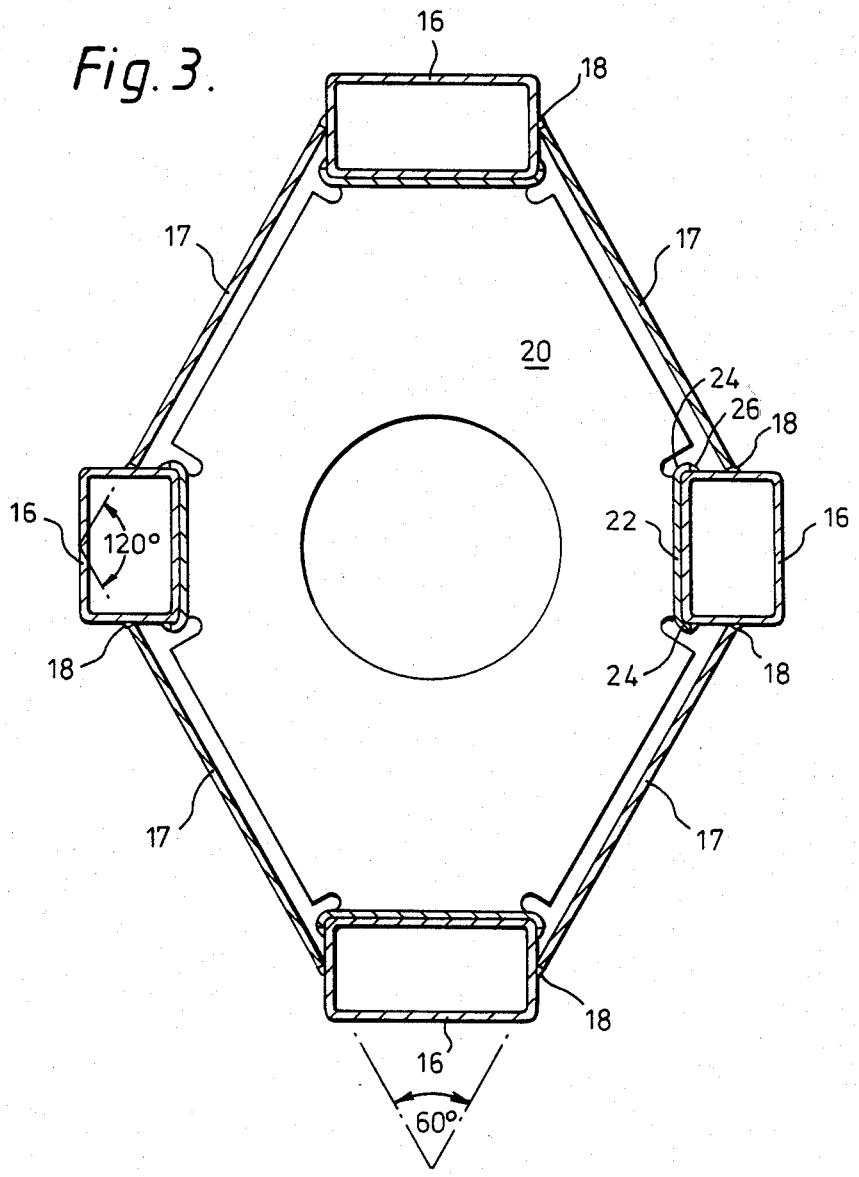
FIG. 3 is a cross-section of the boom of FIG. 1 to an enlarged scale taken at a position A—A along the boom where there is a diaphragm plate.

The boom construction which can be seen in FIG. 3 is extremely simple and comprises four rectangular hollow section stiffening members 16 interconnected by plane plates 17 which are butt welded, by welds 18 on the outside of the boom, to the members 16. Diaphragm plates 20 also interconnect the members 16 at spaced locations along the boom. The diaphragm plates 20 have location flanges 22 welded to them which are channeled to provide location webs 24 at each side. The diaphragm plates 20 are connected to the members 16 suitably by welds 26 between the webs 24 and the stiffening members 16 or by bolting flanges 22 to members 16.

To assemble the boom the diaphragm plates are set up at the predetermined spaced locations and the members 16 are attached to them. The plates 17 are then butt welded between the members 16 taking advantage of the natural presentation formed by the angle between the edge of each plate 17 and the mating surface of each member 16. In order to hold the plates 17 in contact with the members 16 for welding, the plates may be dogged to the diaphragm plates which eliminates the necessity for tack welding.

Referring back to FIG. 3, it will be seen that the plates 17 conform to a diamond shaped parallelogram, the base angle being 65° and the side angle being 115° to 120° but these can be varied dependent on the loading conditions, the minimum base angle being 60° but the normal base angle being between 62° and 69°.

Figure 4:
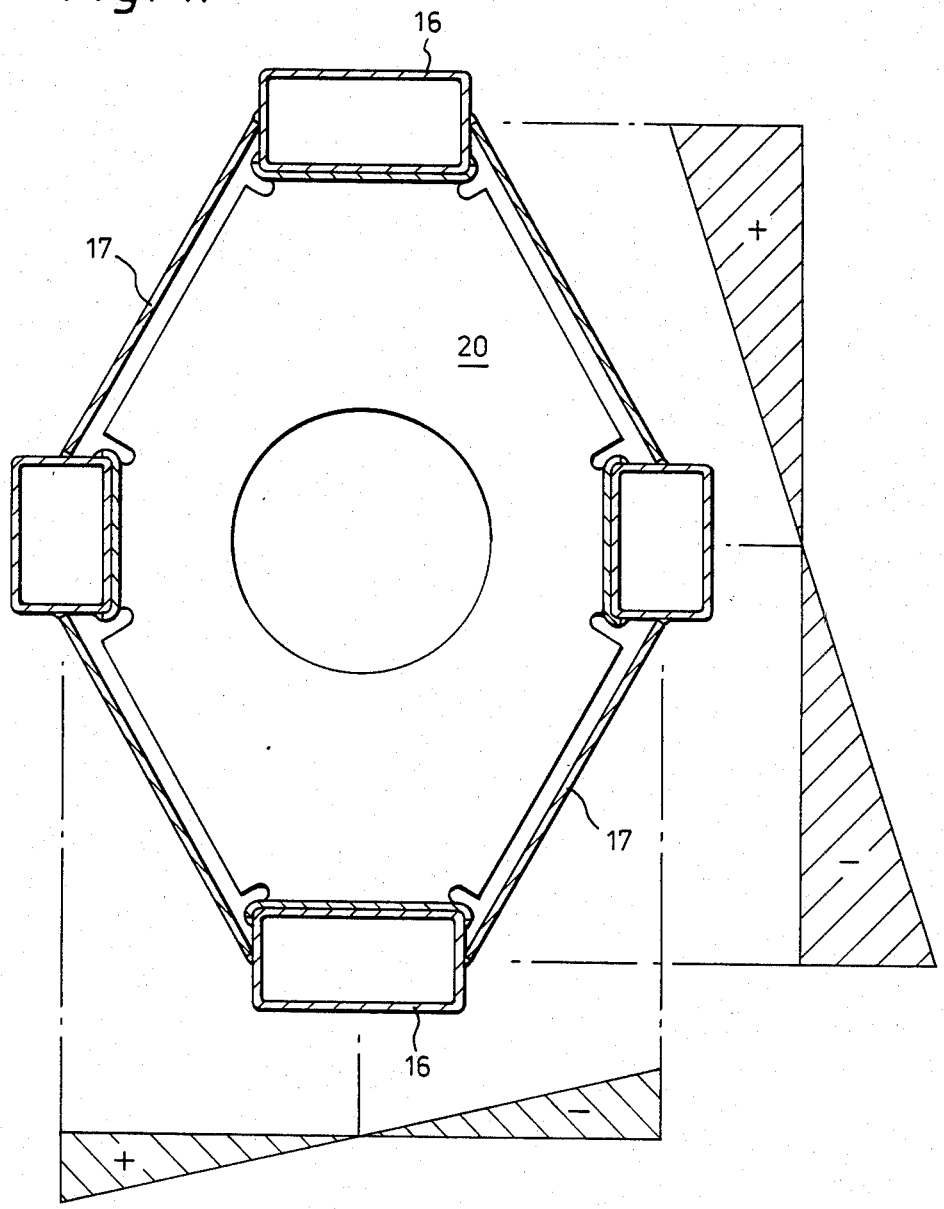
FIG. 4 is a diagram of stress distribution in the boom of FIG. 1 caused by normal and lateral bending moments.

The stress distribution in the boom is shown in FIG. 4 where it will be seen to be substantially symmetrical both for stresses caused by boom whip, that is lateral stress and stresses caused by normal boom loading, that is stresses due to the boom weight and boom load. With this diamond shaped construction it can be seen that the maximum stresses FXX and FYY are never combined in full as they are in a rectangular construction, the corner joint of a rectangular construction having imposed stresses of FXX±FYY. In the present diamond construction the imposed stresses at the lowest joint at FXX±K (FYY) where K is typically 0.25 to 0.3. This lower variation in stress is of great significance when fatigue life is a prime consideration.

An example of a mobile crane with which a boom of this invention may be used is described in detail in the specification of our co-pending U.S. application Ser. No. 409,222.

I claim:

1. A boom for a crane comprising:

four longitudinal stiffening members spaced apart;

four substantially flat longitudinal plates, each plate being welded between adjacent stiffening members, the arrangement being so constructed as to form a boom with a substantially diamond shaped parallelogram cross-section;

and transverse plates extending transversely to and between the stiffening members and secured thereto at spaced locations along the boom, said transvers plates being spaced apart from the longitudinal plates.

2. A boom as claimed in claim 1 in which said stiffening members are of rectangular hollow section.

3. A boom as claimed in claim 1 in which the welds connecting each longitudinal plate to adjacent stiffening members are external butt welds running along the length of the boom.

4. A boom as claimed in claim 1 in which said transverse plates have location flanges configured to mate with said stiffening members and by which the transverse plates are secured to the stiffening members.

5. A boom as claimed in claim 1 wherein the transverse plates are welded to the stiffening members.

6. A boom as claimed in claim 1 wherein said longitudinal plates are arranged at first, second, third and fourth included angles relative to adjacent longitudinal plates, said first and third angles being opposite one another and substantially greater than said second and fourth angles.

7. A boom as claimed in claim 6 wherein said first and third angles are substantially equal.

8. A boom as claimed in claim 7 wherein said first and third angles are about 62°–69°.

9. A boom comprising:

four spaced apart longitudinal stiffening members having hollow rectangular cross sections;

four substantially flat longitudinal plates, each plate being welded between adjacent stiffening members with external butt welds running the lengths of the stiffening members, the arrangement being so constructed as to form a boom with a substantially diamond shaped parallelogram cross-section;

a plurality of transverse plates secured to and mounted between the stiffening members at spaced apart locations and spaced apart from the longitudinal plates, the transverse plates having location flanges configured for complementary mating engagement with the stiffening members.

* * * * *